US006985597B2

(12) United States Patent
Akino

(10) Patent No.: US 6,985,597 B2
(45) Date of Patent: Jan. 10, 2006

(54) VARIABLE DIRECTIONAL CAPACITOR MICROPHONE COMPRISING ELASTIC ACOUSTIC RESISTING MEMBER

(75) Inventor: Hiroshi Akino, Sagamihara (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 0 days.

(21) Appl. No.: 11/016,941

(22) Filed: Nov. 30, 2004

(65) Prior Publication Data

US 2005/0135641 A1 Jun. 23, 2005

(30) Foreign Application Priority Data

Dec. 18, 2003 (JP) ..... 2003-421046

(51) Int. Cl.
*H04R 25/00* (2006.01)

(52) U.S. Cl. ..... 381/174; 381/191

(58) Field of Classification Search ..... 381/113, 381/114, 116, 173, 174, 190, 191, 355–360, 381/368, 369; 29/25.41, 25.42
See application file for complete search history.

(56) References Cited

U.S. PATENT DOCUMENTS 4,156,800 A * 5/1979 Sear et al. ..... 381/114

FOREIGN PATENT DOCUMENTS

JP 07143595 * 6/1995
JP 3299829 4/2002

* cited by examiner

*Primary Examiner*—Huyen Le
(74) *Attorney, Agent, or Firm*—Welsh & Katz, LTD

(57) ABSTRACT

The present invention includes a variable directional capacitor microphone in which two capacitor elements are combined. Each of the capacitor elements includes a vibrating plate and a fixed electrode, and an acoustic resistance can be adjusted in the state that the microphone has been assembled. The variable directional capacitor microphone of this invention includes capacitor elements 10*a,* 10*b.* In each of the capacitor elements 10*a,* 10*b,* each of vibrating plate supporting members 12*a,* 12*b,* each of spacer rings 13*a,* 13*b,* each of fixed electrodes 14*a,* 14*b* having through holes 141 and each of pedestals 15*a,* 15*b* having a through hole in each center of the pedestals are assembled in this order, respectively, in each of ring-shaped cases 16*a,* 16*b.* Each of vibrating plates 11*a,* 11*b* is strained and fixed on each of vibrating plate supporting members 12*a,* 12*b,* respectively. The capacitor elements 10*a,* 10*b* are combined through a connecting ring 22 having female screw threads 221 with the pedestal 15*a,* 15*b* facing back-to-back. An elastic acoustic resisting member 31 is disposed between the pedestals 15*a,* 15*b.* The acoustic resistance of the acoustic resisting member 31 can be adjusted with the lengths of thread engagement of the pedestals 15*a,* 15*b* with the connecting ring 22.

4 Claims, 4 Drawing Sheets

VARIABLE DIRECTIONAL CAPACITOR MICROPHONE COMPRISING ELASTIC ACOUSTIC RESISTING MEMBER

FIELD OF THE INVENTION

The present invention relates to a variable directional microphone. More particularly, the invention relates to the variable directional microphone having two capacitor elements each of which includes a vibrating plate and a fixed electrode with the both capacitor elements combined in the microphone.

BACKGROUND OF THE INVENTION

Japanese Patent registration No. 3299829 discloses a variable directional capacitor microphone including two capacitor elements each of which has a vibrating plate and a fixed electrode. The two capacitor elements are combined as to supply a part of sound pressure impressed to a vibrating plate of the one capacitor element (a rear capacitor element) to the back side of a vibrating plate of the other capacitor element (a front capacitor element). The structure will be described referring to FIGS. 3 and 4. FIG. 3 is a cross sectional view of the variable directional capacitor microphone which has been assembled and FIG. 4 is an exploded cross sectional view of that of FIG. 3.

The variable directional capacitor microphone includes a first and a second capacitor elements 10*a*, 10*b*. Each of the capacitor elements has the same structure so that the first capacitor element 10*a* will be explained hereinafter. Constitutional elements corresponding to the second capacitor element 10*b* are attached with the same reference numerals as that of constitutional elements corresponding to the first capacitor element, together with a reference symbol "b".

The capacitor element 10*a* has a case 16*a* which is formed in a ring shape with electric insulating material. A vibrating plate supporting member 12*a*, a spacer ring 13*a*, a fixed electrode 14*a* and pedestal 15*a* are assembled in the case 16*a* in this order. A vibrating plate 11*a* is fixed and strained with a predetermined tension force on the vibrating plate supporting member 12*a*.

The case 16*a* has an inner edge flange 161 latched with the circumference of the vibrating plate supporting member 12*a* and female screw threads 162 formed on an inner surface of a body of the case. The outer circumference of the pedestal 15*a* has male screw threads 151 screwed with the female screw threads 162. Therefore, the pedestal 15*a* is screwed to the case 16*a* so that the vibrating plate 11*a* and the fixed electrode 14*a* are faced together and are securely fixed through the spacer ring 13*a*.

An electrode rode 121 is extracted from the vibrating plate supporting member 12*a*. FIG. 3 or 4 illustrates only one through hole 141, however, the fixed electrode 14*a* has a number of through holes 141. The pedestal 15*a* is formed in a saucer-shape with the circumference of the pedestal 15*a* protruding such that an air chamber having a predetermined air volume is formed between the pedestal 15*a* and the fixed electrode 14*a*. The center of the bottom of the pedestal 15*a* has a through hole 152. The both sides of the through hole 152 are covered with two sheets of acoustic resisting members 17*a* and 18*b* formed with nylon mesh or the like.

The first and the second capacitor elements 10*a* and 10*b* are combined through a connecting ring 22 having female screw threads 221 in the state the pedestals 15*a* and 15*b* are faced back-to-back and a gasket 21 formed in a ring shape is disposed between the both pedestals.

Male screw threads 151 of the pedestal 15*a* are screwed from one side of the connecting ring 22 and on the other hand, the male screw threads 151 of the pedestals 15*b* are screwed from the other side of the connecting ring 22. Then the first and the second capacitor elements 10*a* and 10*b* are combined with each other through the connecting ring 22.

A first chamber A1 is formed in the space between the fixed electrode 14*a* and the pedestal 15*a* of the first capacitor element 10*a*, a second air chamber A2 formed in the space between acoustic resisting members 17*a* and 17*b*, a third air chamber A3 formed in the space of the center porting of the gasket with the both sides of the spaced surrounded by the pedestals 15*a* and 15*b*, a fourth air chamber A4 formed between the acoustic resisting members 17*b* and 18*b* of the second capacitor element 10*b*, a fifth air chamber A5 formed between the fixed electrode 14*b* and the pedestal 15*b*. The back sides of the vibrating plates 14*a* and 14*b* acoustically communicate through the acoustic capacities connecting in a ladder-form of the five air chambers A1 to A5.

According to the prior art of the structure described above, each of the first and the second capacitor elements 10*a* and 10*b* can be operated respectively before the both elements are combined so that a pair of capacitor elements having similar technical performances are selected and combined to obtain a microphone having wholly stable characteristics.

The variable directional capacitor microphone of the prior art described above is required that the output of each of the capacitor elements 10*a*, 10*b* has a satisfactory cardioid directional characteristic in the state that each of the capacitor elements has been assembled.

Therefore, the capacitor elements 10*a*, 10*b* are combined, after each of the capacitor elements has been adjusted such that an acoustic resistance of each capacitor element has a predetermined value.

However, no expected characteristics may be obtained after the capacitor elements have been combined. In this case the acoustic resistance should be re-adjusted. In the above-described example of the prior art, the acoustic resistance cannot be adjusted in the state that the both capacitor elements have been left combined so that the connecting ring should be removed and the acoustic resistance should be re-adjusted after each of the capacitor elements has been decomposed. However, there is no guarantee that the adjustment of the acoustic resistance is completed only once.

SUMMARY OF THE INVENTION

It is an object of the present invention to provide a variable directional capacitor microphone in which two capacitor elements are combined. Each of the capacitor elements includes a vibrating plate and a fixed electrode, and an acoustic resistance can be adjusted in the state that the microphone has been assembled.

In order to achieve the object, the variable directional capacitor microphone includes a first and a second capacitor elements. In the first capacitor element, a first vibrating plate supporting member on which a first vibrating plate is fixed and strained, a first spacer ring, a first fixed electrode having through holes and a first pedestal having a through hole in the center thereof are integratedly assembled in this order in a first case which is formed in a ring-shape. In the second capacitor element, a second vibrating plate supporting member on which a second vibrating plate is fixed and strained, a second spacer ring, a second fixed electrode having through holes and a second pedestal having a through hole in the center thereof are integratedly assembled in this order in a second case which is formed in a ring-shape. The first and the second capacitor elements are combined through a connecting ring having female screw threads in the state that the first and the second pedestals are faced back-to-back. The variable directional capacitor microphone is characterized in that an elastic acoustic resisting member is disposed between the first and the second pedestals and the disposed position of the acoustic resisting member corresponds to the through hole bored in the center of each of the pedestals.

An acoustic resistance of the acoustic resisting member can be adjusted with adjusting compress volume of the resisting member.

In this invention, it is preferable that an elastic gasket formed with rubber material or the like is disposed around the circumference of the acoustic resisting member installed between the first and the second pedestals to prevent sound leakage through the acoustic resisting member.

In this case, from the viewpoint to cut the relation ship between compressed volume of the acoustic resisting member and that of the gasket and to increase degree of freedom of the compressed volume, it is preferable that a groove having a predetermined depth for receiving a part of each side of the acoustic resisting member is formed on one side of each through hole of the first and the second pedestals.

Further, an aspect that each through hole of the first and the second pedestals is covered with an acoustic resisting mesh member is included in this invention.

According to the invention, the compressed volume of the elastic acoustic resisting member is variable with the degree of fastening each of the pedestals to the connecting ring so that the acoustic resistance can be adjusted. Therefore, the acoustic resistance can be adjusted to obtain a good directional characteristic in the state that each of the capacitor elements has been left combined (assembled) through the connecting ring.

DETAILED DESCRIPTION OF THE PREFERRED EMBODIMENTS

Figure 1:
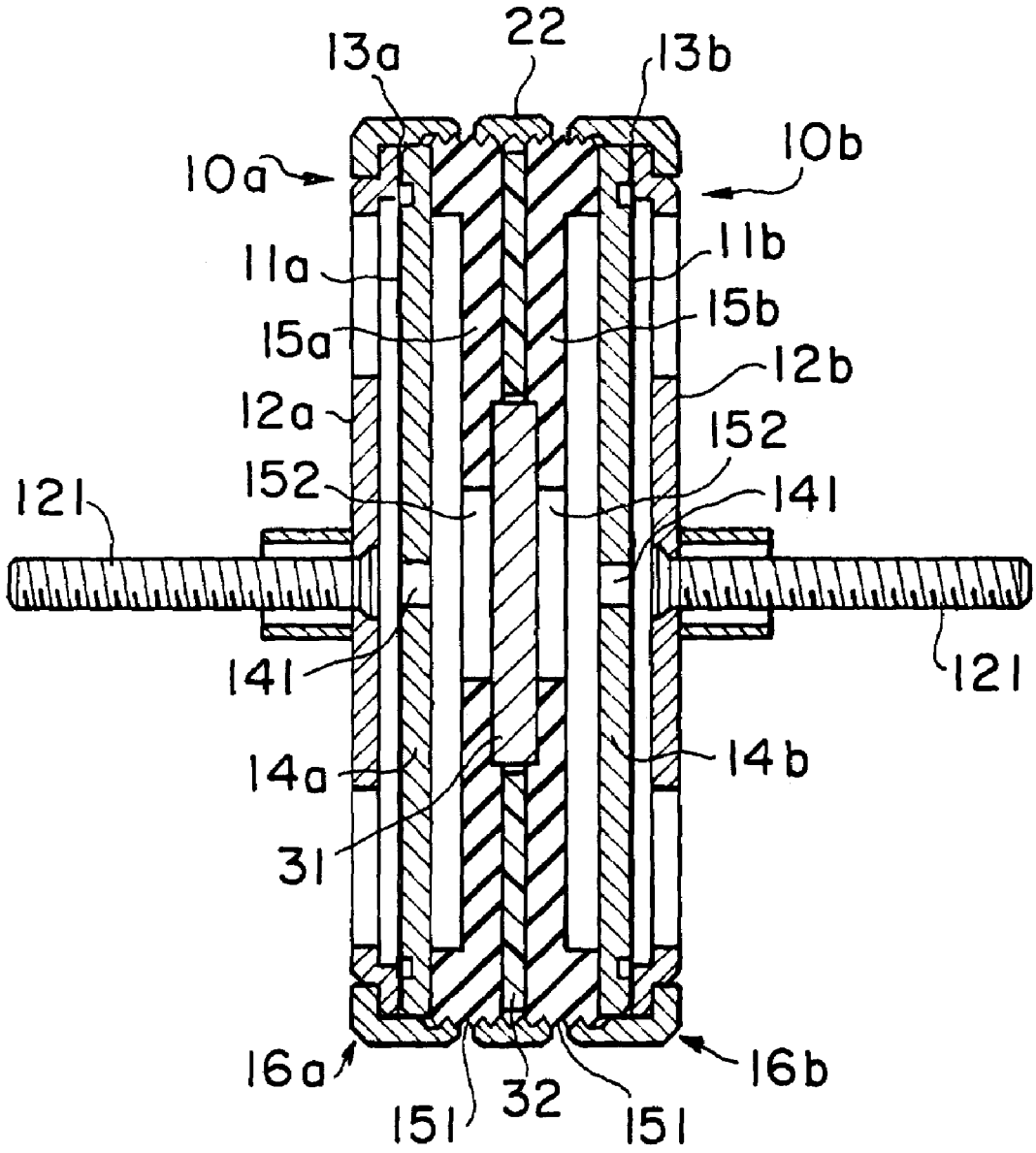
FIG. 1 is a cross sectional view of a variable directional capacitor microphone which has been assembled embodying the present invention.
Figure 2:
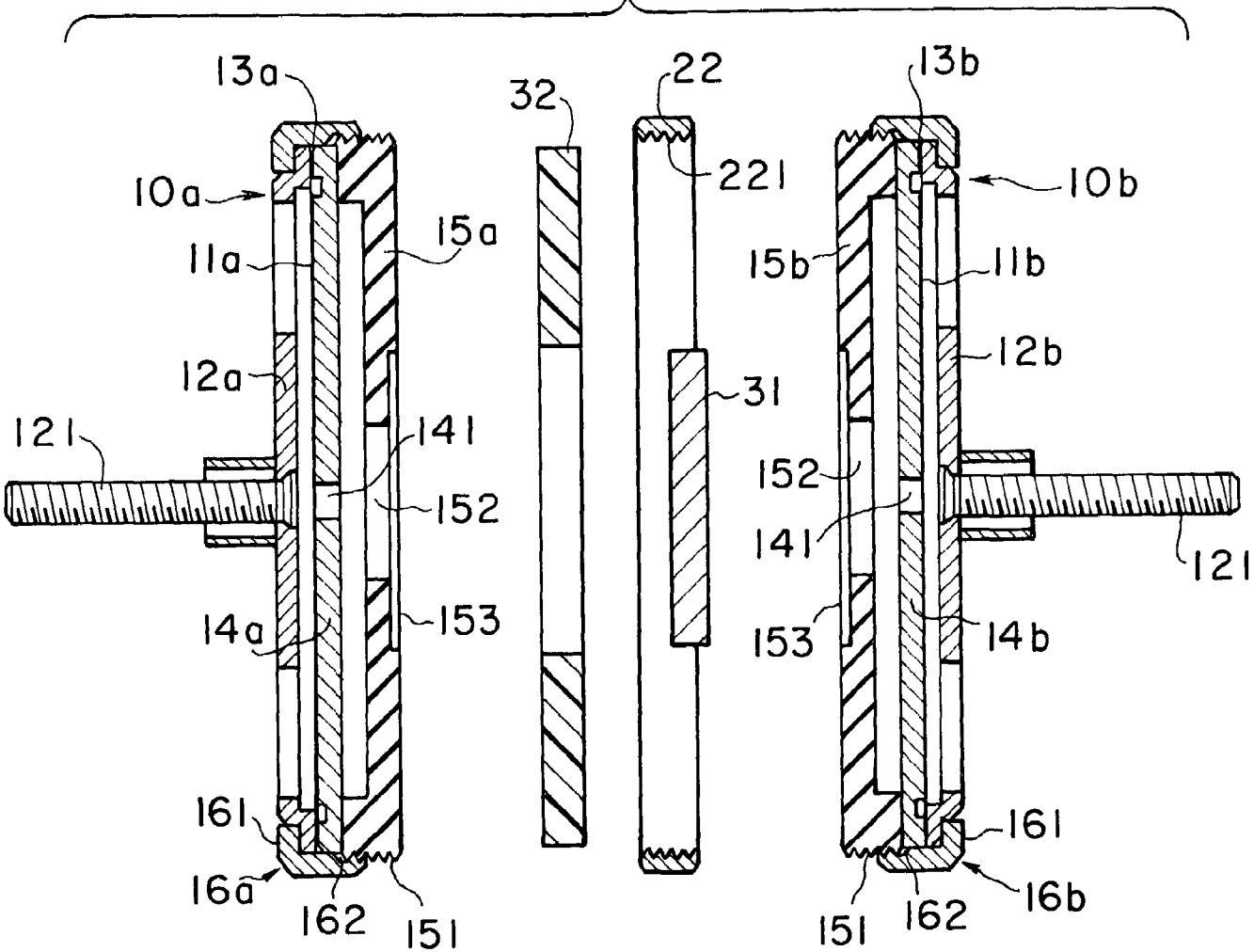
FIG. 2 is an exploded cross sectional view of the variable directional capacitor microphone embodying the present invention.
Figure 3:
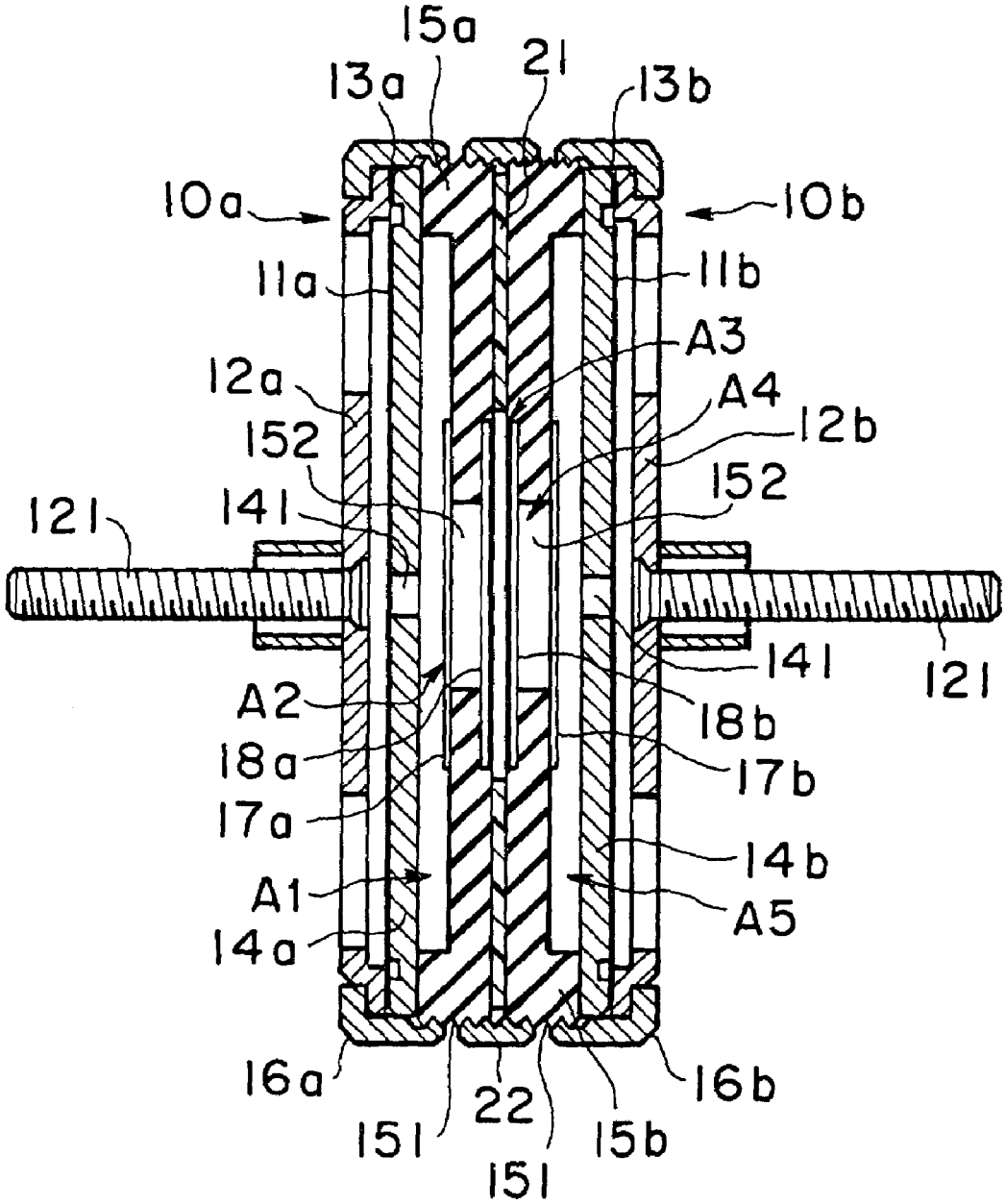
FIG. 3 PRIOR ART
FIG. 3 is a cross sectional view of a variable directional capacitor microphone which has been assembled of a prior art.
Figure 4:
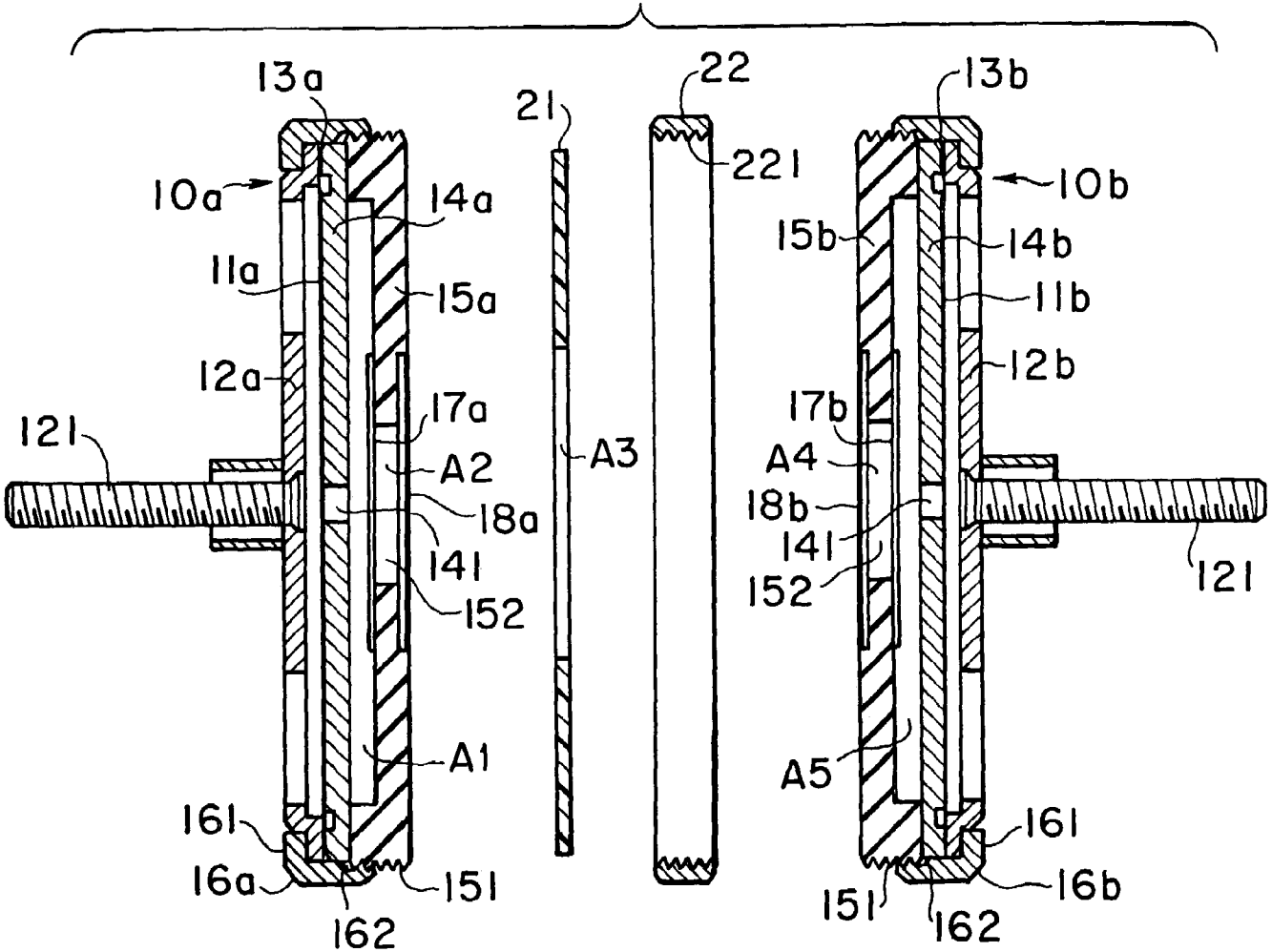
FIG. 4 PRIOR ART
FIG. 4 is an exploded cross sectional view of the variable directional capacitor microphone of the prior art.

Referring to FIGS. 1 and 2, an embodiment of the present invention will be described. The invention is not restricted to this embodiment. FIG. 1 is a cross sectional view of a variable directional capacitor microphone which has been assembled embodying the present invention. FIG. 1 corresponds to FIG. 3 described before. FIG. 2 is an exploded cross sectional view of the variable directional capacitor corresponding to FIG. 4 described before. In the explanation of the embodiment, attached to the constituent elements which are the same or are deemed to be the same as that of a prior art are the same reference numerals and symbols as that of the prior art.

As the basic structure, the variable directional capacitor microphone of the invention includes a first and a second capacitor elements with the both elements combined through a connecting ring 22. Since the first and the second capacitor elements have the same structure as described above, hereinafter, the first capacitor element will be mainly described, however, the reference numerals and symbols of the constitutional elements relating to the second capacitor element will be written in parentheses.

The capacitor element 10*a* (10*b*) has a case 16*a* (16*b*) which is formed with electric insulating material. A vibrating plate supporting member 12*a* (12*b*), a spacer ring 13*a* (13*b*), a fixed electrode 14*a* (14*b*) and pedestal 15*a* (15*b*) are assembled in the case 16*a* (16*b*) in this order. A vibrating plate 11*a* (11*b*) is strained with a predetermined tension force and fixed on the vibrating plate supporting member 12*a* (12*b*).

The case 16*a* (16*b*) has an inner edge flange 161 latched with the circumference of the vibrating plate supporting member 12*a* (12*b*) and female screw threads 162 formed on the inner surface of the body of the case. The outer circumference of the pedestal 15*a* (15*b*) has male screw threads 151 screwed with the female screw threads 162. Therefore, the vibrating plate 11*a* (11*b*) and the fixed electrode 14*a* (14*b*) are faced through the spacer ring 13*a* (13*b*) and are securely fixed by screwing the insulating pedestal 15*a* (15*b*) to the case 16*a* (16*b*).

An electrode rode 121 is extracted from the vibrating plate supporting member 12*a* (12*b*), respectively. FIG. 1 or 2 illustrates only one through hole 141, however, the fixed electrode 14*a* (14*b*) has a number of through holes 141. The pedestal 15*a* (15*b*) is formed in a saucer-shape with the circumference of the pedestal protruding such that an air chamber having a predetermined air volume is formed between the pedestal and the fixed electrode. The center of the bottom of the pedestal has a through hole 152.

The male screw threads 151, 151 of the pedestal 15*a*, 15*b* are screwed to the female screw threads 221 of a connecting ring 22 with the pedestals 15*a* and 15*b* facing back-to-back so that the first and the second capacitor elements 10*a*, 10*b* having the structure described above are combined. Further, an acoustic resisting member 31 which has a larger diameter than that of the through hole 152 is coaxially disposed between the pedestals 15*a* and 15*b*. That is, each of the through holes 152 is covered with the acoustic resisting member 31.

The acoustic resisting member 31 is formed with a spongy elastic material which has continuous air bubbles. An acoustic resistance of the spongy material changes with a compressed volume thereof. For example, product No. HR 50 of urethane sponge of Bridgestone Corporation is exemplified as the acoustic resisting member.

The acoustic resisting member 31 can be disposed in the whole area between the pedestals 15*a*, 15*b*, however, it is preferable that an elastic gasket 32 formed with rubber material or the like is disposed around the circumference of the acoustic resisting material 31 in order to prevent a sound leakage through the acoustic resisting material 31.

According to this structure, the compressed volume of the acoustic resisting member 31 or the acoustic resistance is variable with the length of thread engagement of the pedestal 15*a*, 15*b* with the connecting ring 22 so that the acoustic resistance between the vibrating plates 11*a* and 11*b* can be adjusted in the state that the first and the second capacitor elements 10*a* and 10*b* have been assembled.

In the case that the gasket 32 is disposed around the acoustic resisting member 31, when the gasket 32 is tightly pressed, the acoustic resisting member 31 is compressed until the resisting member 31 becomes the same thickness as that of the gasket because the gasket is harder than the acoustic resisting member so that an appropriate acoustic resistance may not be obtained.

In order to prevent the case described above and to increase degree of freedom of the compressed volume of the acoustic resisting member 31, as shown in FIG. 2, a groove 153 having a predetermined depth for receiving a part of each side of the acoustic resisting member 31 is formed on one side of each through hole 152 of the pedestal 15*a,* 15*b*. The groove 153 is also used as positioning means of the acoustic resisting member 31.

An acoustic resisting member formed with nylon mesh or the like, which is not shown in FIG. 1 or 2, can be installed on the both sides (or one side) of the through hole 152. This aspect is included in this invention.

What is claimed is:

1. A variable directional capacitor microphone including a first and a second capacitor elements, in the first capacitor element a first vibrating plate supporting member, a first spacer ring, a first fixed electrode having through holes and a first pedestal having a through hole in the center of the pedestal integratedly assembled in this order in a first case formed in a ring-shape, a first vibrating plate strained and fixed on the first vibrating plate supporting member, in the second capacitor element a second vibrating plate supporting member, a second spacer ring, a second fixed electrode having through holes and a second pedestal having a through hole in the center of the pedestal integratedly assembled in this order in a second case formed in a ring-shape, a second vibrating plate strained and fixed on the second vibrating plate supporting member, the first and the second capacitor elements combined through a connecting ring having female screw threads with the first and the second pedestals faced back-to-back, the variable directional capacitor microphone comprising:

an elastic acoustic resisting member disposed between the first and the second pedestals; and the acoustic resisting member disposed in the position corresponding to the through hole bored in the center of each of the pedestals;

wherein an acoustic resistance of the elastic acoustic resisting member is capable of being adjusted in the state that each of the capacitor elements has combined and is capable of being varied depending on the degree of fastening each of the pedestals to the connecting ring.

2. A variable directional capacitor microphone according to claim 1, wherein an elastic gasket is disposed around the circumference of the acoustic resisting member installed between the first and the second pedestals, so that the acoustic resisting member and the gasket are compressed between said first and second pedestals and the gasket prevents sound exchange through the acoustic resisting member.

3. A variable directional capacitor microphone according to claim 2, wherein a groove having a predetermined depth for receiving one side of each acoustic resisting member is formed on one side of the through hole of the first and the second pedestals, so that if the first and second pedestals are tightly fastened, an acceptable acoustic resistance of the acoustic resisting member is obtained.

4. A variable directional capacitor microphone according to claim 1, wherein a groove having a predetermined depth for receiving one side of each acoustic resisting member is formed on one side of each through hole of the first and the second pedestals, so that if the first and the second pedestals are tightly fastened, an acceptable acoustic resistance of the acoustic resisting member is obtained.

* * * * *